US009930461B2

(12) United States Patent
Calmel et al.

(10) Patent No.: US 9,930,461 B2
(45) Date of Patent: Mar. 27, 2018

(54) METHOD USING A LOUDSPEAKER COMPRISING A MODULE FOR GENERATING A VALUE REPRESENTATIVE OF THE INTERNAL OPERATION OF THE LOUDSPEAKER

(71) Applicant: DEVIALET, Paris (FR)

(72) Inventors: Pierre-Emmanuel Calmel, Le Chesnay (FR); Charles Coqueret, Paris (FR); Maxime Leblanc, Vitry sur Seine (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 15/311,372

(22) PCT Filed: Apr. 16, 2015

(86) PCT No.: PCT/EP2015/058304
§ 371 (c)(1),
(2) Date: Nov. 15, 2016

(87) PCT Pub. No.: WO2015/158847
PCT Pub. Date: Oct. 22, 2015

(65) Prior Publication Data

US 2017/0164126 A1 Jun. 8, 2017

(30) Foreign Application Priority Data

Apr. 17, 2014 (FR) ..... 14 53507

(51) Int. Cl.
*H04R 29/00* (2006.01)
*G08B 7/06* (2006.01)

(52) U.S. Cl.
CPC ..... *H04R 29/001* (2013.01); *G08B 7/06* (2013.01)

(58) Field of Classification Search
CPC ..... H04R 1/028; H04R 29/001; G08B 7/06
(Continued)

(56) References Cited

U.S. PATENT DOCUMENTS

2007/0116084 A1* 5/2007 Rund ..... G01K 1/022 374/100

FOREIGN PATENT DOCUMENTS

| | | | |
|---|---|---|---|
| GB | 2390908 | A | 1/2004 |
| WO | 2010/074547 | A1 | 7/2010 |
| WO | 2011/076288 | A1 | 6/2011 |

OTHER PUBLICATIONS

PCT International Search Report and PCT Written Opinion of ISA dated Jul. 9, 2015 and PCT IPRP dated Oct. 18, 2016 issued in corresponding PCT International Application No. PCT/EP2015/058304.

(Continued)

*Primary Examiner* — Paul S Kim
*Assistant Examiner* — Katherine Faley
(74) *Attorney, Agent, or Firm* — Troutman Sanders LLP

(57) ABSTRACT

The invention relates to a method implementing at least one loudspeaker comprising at least one module suitable for generating a value representative of an internal operation of the loudspeaker, and a memory unit for storing an alarm criterion relative to the generated value, and control software for controlling the loudspeaker. The method further comprising the steps of the module produces a value representative of the internal operation of the loudspeaker, the loudspeaker compares the generated value and the alarm criterion, and the loudspeaker emits a sound or visual signal if the result of the comparison indicates that the generated value fulfills the alarm criterion.

10 Claims, 1 Drawing Sheet

(58) Field of Classification Search
USPC ..... 381/59
See application file for complete search history.

(56) References Cited

OTHER PUBLICATIONS

French Search Report dated Dec. 1, 2014 issued in corresponding French Application No. 1453507.

* cited by examiner

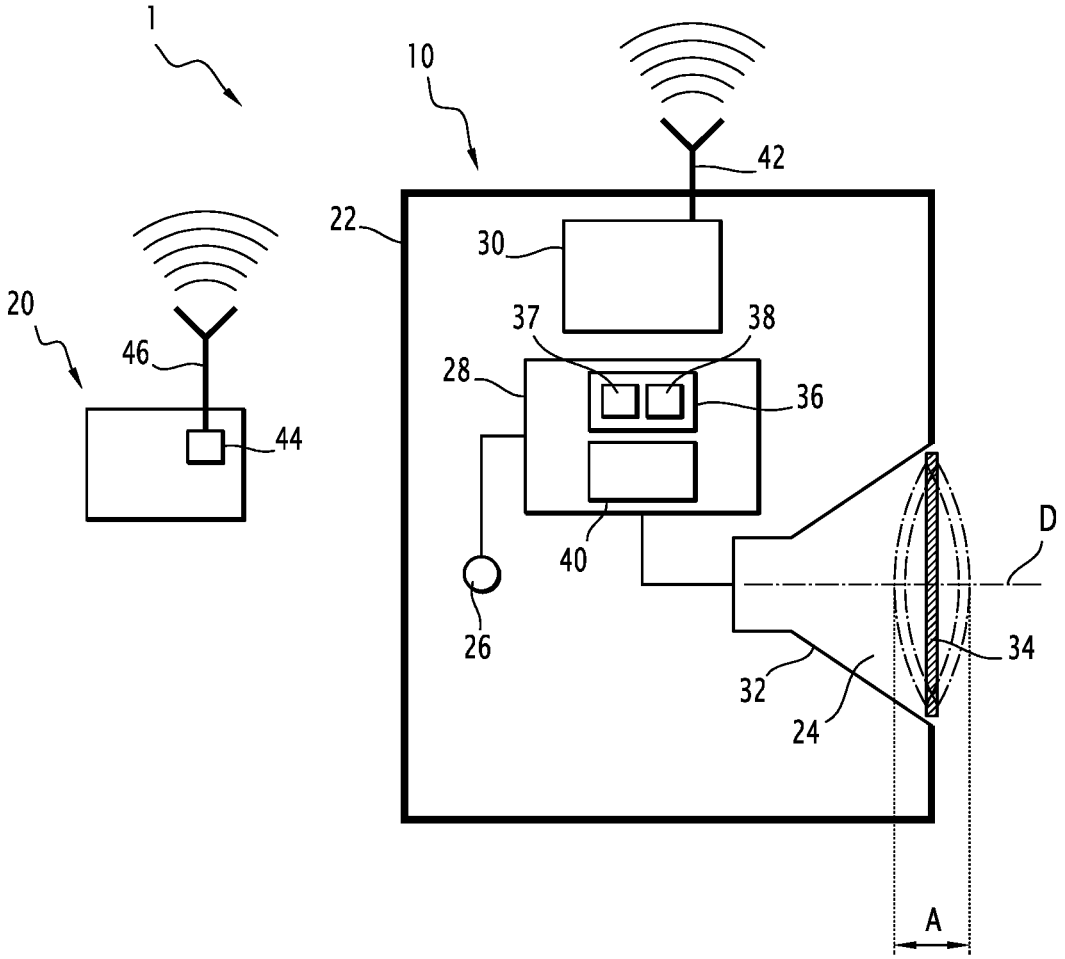
1
10
42
22
30
20
46
37
38
28
36
44
40
D
26
34
32
24
A

METHOD USING A LOUDSPEAKER COMPRISING A MODULE FOR GENERATING A VALUE REPRESENTATIVE OF THE INTERNAL OPERATION OF THE LOUDSPEAKER

CROSS-REFERENCE TO RELATED APPLICATIONS

This application is a National Stage of International Application No. PCT/EP2015/058304, filed Apr. 16, 2015. This application, in turn, claims priority to French Patent Application No. 1453507, filed Apr. 17, 2014. Both applications are incorporated herein by reference.

FIELD OF THE INVENTION

The present invention relates to a method using at least one loudspeaker comprising at least one module for generating a value representative of an internal operation of the loudspeaker.

The present invention also relates to a corresponding loudspeaker.

The value is for example a Boolean variable representative of the operation of the loudspeaker or a subassembly of the loudspeaker. According to another example, the value is a physical value, such as the internal temperature of the loudspeaker.

BACKGROUND

One problem that arises for the user of the loudspeaker is detecting the fact that the value representative of the internal operation of the loudspeaker assumes a value deemed abnormal according to a predetermined alarm criterion, in particular when the loudspeaker does not include a screen for displaying said value.

SUMMARY

One aim of the invention is therefore to provide a method implementing such an apparatus and suitable for signaling that the value generated by the module fulfills a predetermined alarm criterion.

To that end, the invention relates to a method implementing at least one loudspeaker including:

- at least one module suitable for generating a value representative of an internal operation of the loudspeaker, and
- a memory unit for storing an alarm criterion relative to the generated value, and control software for controlling the loudspeaker, the method including the following steps:

- the module produces said value representative of the internal operation of the loudspeaker,
- the loudspeaker compares the generated value and the alarm criterion, and
- the loudspeaker emits a sound or visual signal if the result of the comparison indicates that the generated value fulfills the alarm criterion.

According to particular embodiments, the method comprises one or more of the following features, considered alone or according to any technically possible combinations:

- the value representative of the internal operation of the loudspeaker is a physical value, the module including a sensor for measuring said physical value;

- the value representative of the internal operation of the loudspeaker is suitable for indicating an interruption in the operation of a member of the loudspeaker;
- the loudspeaker comprises at least one membrane able to emit sound waves, said visual signal including beats of the membrane detectable by the user's eye; and
- the beats of the membrane have a non-zero frequency less than or equal to 20 Hz, preferably less than or equal to 15 Hz.

The invention also relates to a loudspeaker, including:

- at least one module suitable for generating a value representative of an internal operation of the loudspeaker and obtaining a generated value, and
- a memory unit for storing an alarm criterion relative to the generated value, and control software for controlling the loudspeaker, the loudspeaker being able to compare the generated value and the alarm criterion, and to emit a sound or a visual signal if the result of the comparison indicates that the generated value fulfills the alarm criterion.

According to specific embodiments, the loudspeaker includes one or more of the following features, considered alone or according to any technically possible combination(s):

- the value representative of the internal operation of the loudspeaker is a physical value, the module including a sensor for measuring said physical value;
- the value representative of the internal operation of the loudspeaker is suitable for indicating an interruption in the operation of a member of the loudspeaker;
- the loudspeaker comprises at least one membrane able to emit sound waves, said visual signal including beats of the membrane detectable by the user's eye; and
- the beats of the membrane have a non-zero frequency less than or equal to 20 Hz, preferably less than or equal to 15 Hz.

BRIEF DESCRIPTION OF THE DRAWING

The invention will be better understood upon reading the following description, provided solely as an example and done in reference to the appended drawing.

FIG. 1 is a diagrammatic view of an installation according to the invention, i.e., incorporating a loudspeaker according to the invention.

DETAILED DESCRIPTION

In reference to FIG. 1, an installation 1 according to the invention is described.

The installation 1 includes a loudspeaker 10, and a remote unit 20 that is for example a server.

The installation 1 is for example a loudspeaker installation in a room or performance hall (not shown).

According to one alternative that is not shown, the installation 1 further includes one or several other apparatuses structurally similar to the loudspeaker 10.

Alternatively (not shown), the loudspeaker 10 is a temperature sensor or any other home automation sensor known by those skilled in the art, advantageously intended to be situated in a given room of a larger whole (not shown), such as an apartment.

The loudspeaker 10 includes a housing 22, and at least one speaker 24 arranged in an opening of the housing. The loudspeaker 10 further includes a module 26 suitable for generating a value representative of the internal operation of the loudspeaker 10, a processing unit 28, and advantageously a communication unit 30 suitable for exchanging information with the remote unit 20.

The housing 22 may have any shape, for example parallelepiped or substantially spherical. The housing 22 advantageously has no screen for displaying the value representative of the internal operation of the loudspeaker 10.

The speaker 24 is of a type known in itself by those skilled in the art. The speaker 24 for example includes a chassis 32 fastened on the housing 22, and a membrane 34 movable relative to the chassis and suitable for emitting sound waves.

The speaker 24 is further suitable for imparting beating movements to the membrane 34 that are detectable to the eye of a user of the installation 1.

Advantageously, the beating movements have a non-zero frequency less than or equal to 20 Hz, preferably less than or equal to 15 Hz.

The beating movements advantageously have an amplitude A along an axis D of the speaker 24 comprised between 0.1 and 50 mm, preferably between 1 mm and 20 mm.

The axis D is for example defined as the axis of a coil (not shown) used to move the membrane 34 relative to the chassis 32, or as an axis of symmetry of the membrane 34 when idle.

The module 26 is for example a sensor for measuring a physical value representative of the internal operation of the loudspeaker 10.

The physical value is for example a temperature, a pressure, an electrical voltage or an electrical intensity. The physical property is advantageously measured inside the loudspeaker 10.

According to another embodiment, the module 26 is suitable for generating a variable, for example Boolean, representative of the internal operation of a member of the loudspeaker 10. For example, the Boolean variable is equal to 0 or 1 depending on whether the internal operation of the communication unit 30 is normal or abnormal.

Abnormal operation for example refers to the fact that the communication unit 30 is disconnected from the remote unit 20 or is no longer able to connect to the remote unit 20.

Thus, the value 0 advantageously indicates a malfunction of all or part of the loudspeaker 10, for example the communication unit 30.

According to another embodiment, the value generated by the module 26 is a Boolean variable obtained by a mathematical function incorporating several parameters, such as physical measurements or Boolean variables representative of the operation of the loudspeaker 10.

The processing unit 28 includes a memory unit 36 for storing an alarm criterion 37 relative to the value generated by the module 26, and control software 38 for controlling the loudspeaker 10. The processing unit 28 further includes a processor 40 suitable for running the control software 38.

The alarm criterion 37 is advantageously a threshold relative to the value generated by the module 26, for example a maximum temperature threshold. According to another example, if the generated value is a Boolean variable, the alarm criterion 37 is the fact that the Boolean variable is equal to 0.

"Control software" for example refers to any program determining tasks to be performed by the processor 40.

When the processor 40 runs the control software 38, said processor is suitable for reading the alarm criterion 37 in the memory unit 36 and comparing the value generated by the module 26 with the alarm criterion 37.

The communication unit 30 advantageously includes an antenna 42 suitable for communicating with the remote unit 20 using a protocol for example according to standard IEEE 802.11, i.e., by "Wi-Fi".

The remote unit 20 is for example a server. The remote unit 20 includes a communication unit 44 suitable for sending or receiving signals to or from the communication unit 30.

The communication unit 44 advantageously includes an antenna 46 able to exchange electromagnetic signals with the antenna 42.

The information emitted by the communication unit 44 is for example signals intended to be converted into sound waves by the loudspeaker 10. Optionally, the communication unit 44 is suitable for receiving information from the communication unit 42 of the loudspeaker 10.

The operation of the installation 1 will now be described in reference to FIG. 1.

When the loudspeaker 10 is operating, the module 26 for example measures the temperature in its immediate vicinity and generates a value representative of the internal temperature of the loudspeaker 10. "Internal temperature" for example refers to the temperature that prevails in the part of the housing 22 in which the module 26 is located.

The processor 40 runs the control software 38. The processor 40 reads the alarm criterion 37 relative to the value generated by the module 26, i.e., a temperature in the example, in the memory unit 36. The alarm criterion 37 is advantageously a high temperature threshold, for example a threshold of 60° C.

The processor 40 compares the value measured by the module 26 to the value of the alarm criterion 37.

If the result of the comparison shows that the measured value is for example greater than or equal to the threshold contained in the alarm criterion 37, the loudspeaker 10 emits a visual signal made up of beats of the membrane 34.

According to one particular embodiment, these beats are optionally superimposed on vibrations of the membrane 34 intended to generate sound waves.

The visual signal is able to be seen by the user on the loudspeaker 10.

According to another embodiment, if the result of the comparison is that the generated value fulfills the alarm criterion 37, the loudspeaker 10 emits a sound via the membrane 34. The sound is able to be detected by the user as coming from the loudspeaker 10.

Thus, owing to the features described above, the loudspeaker 10 is capable of indicating an internal malfunction corresponding to the alarm criterion 37 to a user.

The invention claimed is:

1. A method implementing at least one loudspeaker comprising:

at least one generator generating a value representative of an internal operation of the at least one loudspeaker, and a memory storing an alarm criterion that indicates an abnormal operation relative to the value, and control software controlling the at least one loudspeaker, the method comprising the steps of:

producing, from the at least one generator, the value, comparing, with the at least one loudspeaker the value and the alarm criterion and producing a comparison result, and emitting with the at least one loudspeaker a visual signal if the comparison result indicates that the value fulfills the alarm criterion, wherein the at least one loudspeaker comprises at least one membrane able to emit sound waves, the visual signal comprising beats of the at least one membrane detectable by a user's eye, so that the user is notified of the abnormal operation.

2. The method according to claim 1, wherein the value is a physical value, the at least one generator comprising a sensor for measuring the physical value.

3. The method according to claim 1, wherein the value is suitable for indicating an interruption in an operation of a member of the at least one loudspeaker.

4. The method according to claim 1, wherein the beats of the at least one membrane have a non-zero frequency less than or equal to 20 Hz.

5. The method according to claim 4, wherein the frequency is less than or equal to 15 Hz.

6. A loudspeaker comprising:

at least one generator generating a value representative of an internal operation of the loudspeaker, and a memory storing an alarm criterion that indicates an abnormal operation relative to the value, and control software controlling the loudspeaker, wherein the loudspeaker compares the value and the alarm criterion, produces a comparison result, and emits a visual signal if the result indicates that the value fulfills the alarm criterion, wherein the loudspeaker comprises at least one membrane able to emit sound waves, the visual signal comprising beats of the at least one membrane detectable by a user's eye, so that the user is notified of the abnormal operation.

7. The loudspeaker according to claim 6, wherein the value is a physical value, the at least one generator comprising a sensor measuring the physical value.

8. The loudspeaker according to claim 6, wherein the value indicates an interruption in an operation of a member of the loudspeaker.

9. The loudspeaker according to claim 6, wherein the beats of the at least one membrane have a non-zero frequency less than or equal to 20 Hz.

10. The loudspeaker according to claim 9, wherein the frequency is less than or equal to 15 Hz.

* * * * *